US010927549B1

(12) United States Patent
Lunsford

(10) Patent No.: US 10,927,549 B1
(45) Date of Patent: Feb. 23, 2021

(54) REBAR SAFETY COVER DEVICE AND METHODS

(71) Applicant: Bryan Lunsford, Marietta, GA (US)

(72) Inventor: Bryan Lunsford, Marietta, GA (US)

( * ) Notice: Subject to any disclaimer, the term of this patent is extended or adjusted under 35 U.S.C. 154(b) by 0 days.

(21) Appl. No.: 16/735,917

(22) Filed: Jan. 7, 2020

(51) Int. Cl.
*E04C 5/16* (2006.01)

(52) U.S. Cl.
CPC ..... *E04C 5/161* (2013.01)

(58) Field of Classification Search
CPC ..... E04C 5/161; E04C 5/16
See application file for complete search history.

(56) References Cited

U.S. PATENT DOCUMENTS 4,090,647 A * 5/1978 Dunning ..... G01F 11/082 222/543
4,202,378 A * 5/1980 Bush ..... E04G 21/32 138/96 R
5,600,927 A * 2/1997 Kennon ..... E04C 5/161 52/301
6,085,478 A * 7/2000 Workman ..... B65D 59/06 52/301
8,141,309 B2 * 3/2012 Kubicek ..... E04G 21/32 52/301
10,590,651 B2 * 3/2020 Parish ..... E04C 5/161
2008/0168726 A1 * 7/2008 Yang ..... E04G 21/32 52/301
2009/0107067 A1 * 4/2009 Beery ..... E04G 21/32 52/301
2009/0288357 A1 * 11/2009 Kubicek ..... E04G 21/32 52/301
2009/0313927 A1 * 12/2009 Myers, Jr. ..... E04G 21/32 52/301
2016/0208491 A1 * 7/2016 Green ..... E04C 5/161
2017/0314270 A1 * 11/2017 Zorio, III ..... E04C 5/161
2018/0334807 A1 * 11/2018 Ryan ..... E04C 5/161
2018/0371756 A1 * 12/2018 Parish ..... E04C 5/161

FOREIGN PATENT DOCUMENTS

WO WO-2019178638 A1 * 9/2019 ..... E04G 21/3252

* cited by examiner

*Primary Examiner* — Rodney Mintz
(74) *Attorney, Agent, or Firm* — Meunier Carlin & Curfman LLC

(57) ABSTRACT

A rebar safety cover may include a cylindrical body, a cap coupled to the cylindrical body, a locking support coupled to at least one of the cylindrical body and the cap, and a locking tab coupled to the locking support. The cylindrical body may define a hollow channel having a first central axis. The locking tab may have an opening extending from a first surface to a second surface of the locking tab and having a second central axis. The locking tab may be configured for moving relative to the cylindrical body from a first position in which a first angle is defined between the first central axis and the second central axis to a second position in which a second angle is defined between the first central axis and the second central axis, with the second angle being less than the first angle.

20 Claims, 16 Drawing Sheets

REBAR SAFETY COVER DEVICE AND METHODS

FIELD OF THE DISCLOSURE

The present disclosure relates generally to construction safety devices and more specifically to a rebar safety cover and methods of using the same.

BACKGROUND OF THE DISCLOSURE

Rebar caps are typically used to cover the end of a rebar during construction of a structure. Metal rebar often have sharp metal ends that require a cover to meet safety standards in a construction environment. Rebar is often disposed partially into a structure or into the ground, leaving an end of the rebar exposed to the environment. Rebar caps are typically used to reduce the possibility of a person being injured by impacting or falling on top of a rebar. Rebar is often disposed in horizontal and vertical positions that require a rebar cover to be placed over the rebar in various positions. Rebar covers are typically made of a single solid material. Rebar covers are typically placed on top of rebar with varying degrees of stability and are often loosely fit on the end of a rebar.

SUMMARY

The present disclosure describes rebar safety cover devices and related methods of use. In one aspect, the rebar safety cover is provided. In some implementations, the rebar safety cover includes a cylindrical body having a first end and a second end. The cylindrical body defines a hollow channel between the first end and the second end, and the hollow channel has a first central axis. In some implementations, the rebar safety cover also includes a cap coupled to the first end of the cylindrical body. In some implementations, the rebar safety cover includes a locking support coupled to at least one of the cylindrical body and the cap. The locking support has a first end and a second end. The second end of the locking support extends beyond the second end of the cylindrical body. In some implementations, the rebar safety cover also includes a locking tab coupled to the locking support. The locking tab has a first surface, a second surface, and an opening. The opening extends from the first surface to the second surface, and the opening has a second central axis. In some implementations, the locking tab is configured for moving relative to the cylindrical body from a first position in which a first angle is defined between the first central axis and the second central axis to a second position in which a second angle is defined between the first central axis and the second central axis. In some implementations, the second angle is less than the first angle.

In some implementations, the rebar safety cover is configured for elastically deforming from the first position to the second position. In some implementations, the first position corresponds to a natural state of the locking tab. In some implementations, the rebar safety cover includes a plurality of circumferential ribs disposed on an interior wall of the cylindrical body. Each of the circumferential ribs defines an interior diameter of the hollow channel. In some implementations, the circumferential ribs are arranged in series along the interior wall of the cylindrical body in a direction of the first central axis. In some implementations, the interior diameter of the hollow channel decreases in a direction from the second end toward the first end of the cylindrical body.

In some implementations, an outer diameter of the first end of the cylindrical body is greater than an outer diameter of the second end of the cylindrical body.

In some implementations, the rebar safety cover includes a plurality of longitudinal ribs disposed along an exterior wall of the cylindrical body. In some implementations, the first surface of the locking tab includes a connection segment. A plane of the connection segment is angled away from a plane of the second surface of the locking tab. In some implementations, the locking tab is coupled to the second end of the locking support via the connection segment.

In some implementations, the cylindrical body, the cap, the locking support, and the locking tab each are formed from a metal core and a high-density polymer shell. In some implementations, the rebar safety cover includes a circular body. In some implementations, the opening in the locking tab has a circular shape.

In some implementations, the rebar safety cover includes a first barrier and a second barrier. The first barrier and the second barrier are each coupled to the cap and extend away from the cylindrical body. The first barrier and the second barrier each include a platform portion having an inner surface and a wall portion having an inner surface. A height of the inner surface of the wall portion is greater than a height of the inner surface of the platform portion. In some implementations, the inner surface of the wall portion of the first barrier is opposite and spaced apart from the inner surface of the wall portion of the second barrier. In some implementations, each of the wall portions includes at least one hole disposed therein. In some implementations, the cap includes at least one hole disposed therein. In some implementations, the platform portions and the wall portions are each formed as semi cylinders. The wall portions form smaller semi cylinders than the platform portions.

In another aspect, a method of covering and uncovering an end of a rebar is provided. In some implementations, the method of covering and uncovering an end of a rebar includes positioning a safety cover relative to the end of the rebar such that the rebar extends through an opening in a locking tab of the safety cover, and a portion of the rebar is received within a hollow channel defined by a cylindrical body of the safety cover. The locking tab is in a first position, in which a first angle is defined between a first central axis of the hollow channel and a second central axis of the opening. In some implementations, the method of covering and uncovering an end of a rebar includes moving the locking tab relative to the cylindrical body from the first position to a second position. A second angle is defined between the first central axis and the second central axis. In some implementations, the second angle is less than the first angle. In some implementations, the method of covering and uncovering an end of a rebar includes removing the safety cover from the rebar. In some implementations, the method of covering and uncovering an end of a rebar includes placing a beam between a first barrier and a second barrier of the safety cover. The first barrier and the second barrier are coupled to a cap of the safety cover and extend away from the cylindrical body. In some implementations, the method of covering and uncovering an end of a rebar includes securing the beam to the safety cover with at least one fastener extending through at least one hole formed in the first barrier or the second barrier. In some implementations, the method of covering and uncovering an end of a rebar includes securing the beam to the safety cover with at least one fastener extending through at least one hole formed in the cap.

DETAILED DESCRIPTION OF THE DISCLOSURE

In the following description, specific details are set forth describing some implementations consistent with the present disclosure. Numerous specific details are set forth in order to provide a thorough understanding of the implementations. It will be apparent, however, to one skilled in the art that some implementations may be practiced without some or all of these specific details. The specific implementations disclosed herein are meant to be illustrative but not limiting. One skilled in the art may realize other elements that, although not specifically described here, are within the scope and the spirit of this disclosure. In addition, to avoid unnecessary repetition, one or more features shown and described in association with one implementation may be incorporated into other implementations unless specifically described otherwise or if the one or more features would make an implementation non-functional. In some instances, well known methods, procedures, and components have not been described in detail so as not to unnecessarily obscure aspects of the implementations.

Implementations of rebar safety covers as well as related methods for covering and uncovering the end of a rebar are provided. As described herein, the rebar safety cover can include a cylindrical body defining a hollow channel. The rebar safety cover can also include a cap coupled to the cylindrical body, a locking support coupled to the cylindrical body and/or the cap, and a locking tab that is coupled to the locking support. The locking tab can have an opening that is configured to accept a rebar through it, releasably securing the rebar when the rebar is inserted into the opening of the locking tab and the hollow channel. The locking tab can move between a first position, where the rebar is secure, to a second position, where the rebar is less secure. The rebar safety cover can advantageously provide a protective cover for exposed rebar and secure the rebar in a protected position, minimizing the possibility of accidental uncovering of the end of a rebar. The rebar safety cover can be formed from a metal core with a high-density polymer outer coating that increases resistance to wear, such as weather conditions and impact, and increases the safety of use by providing a more beneficial interface surface.

Figure 1A:
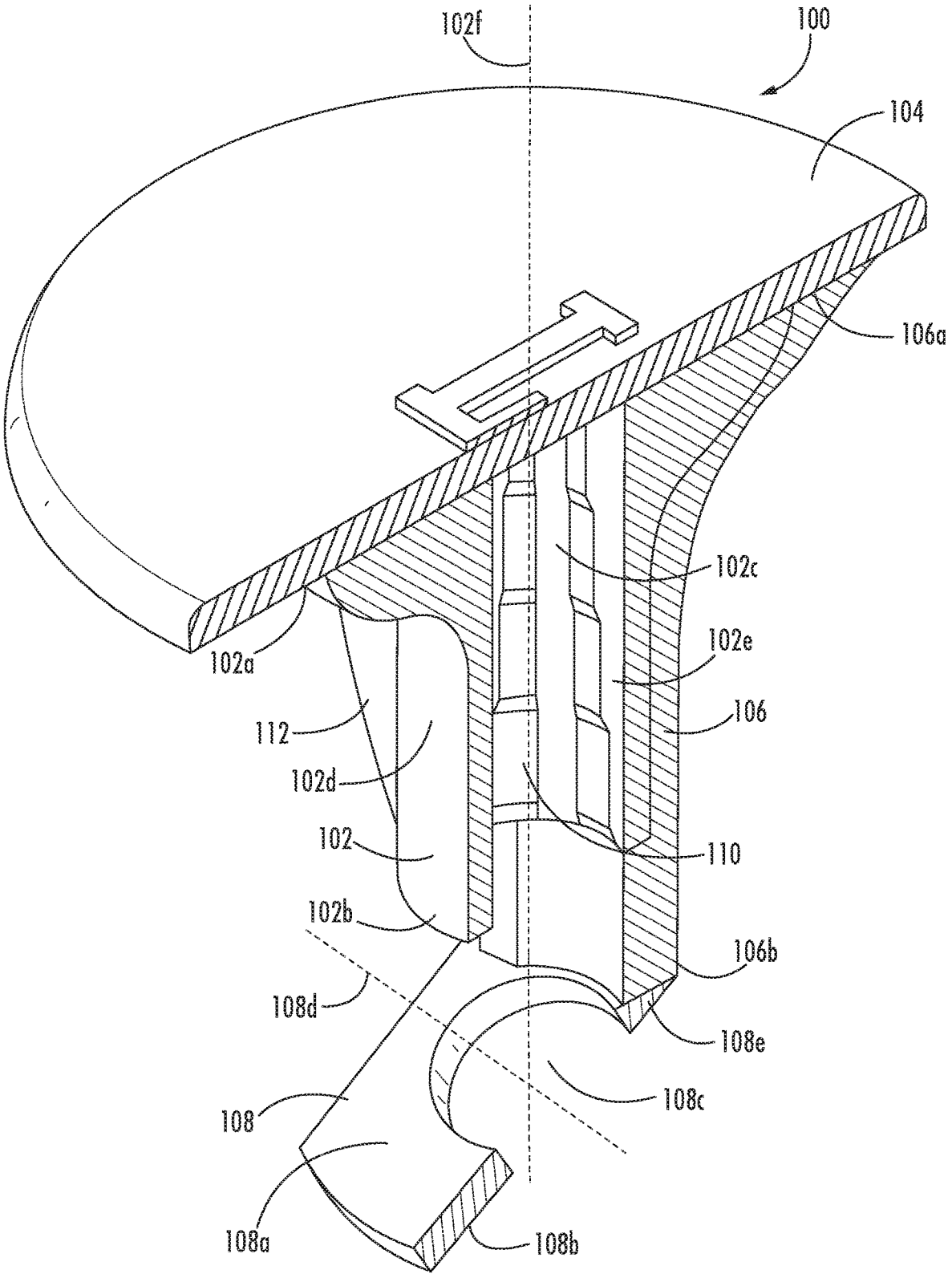
FIG. 1A is a cutaway perspective view of an example rebar safety cover in accordance with one or more implementations of the disclosure.
Figure 1B:
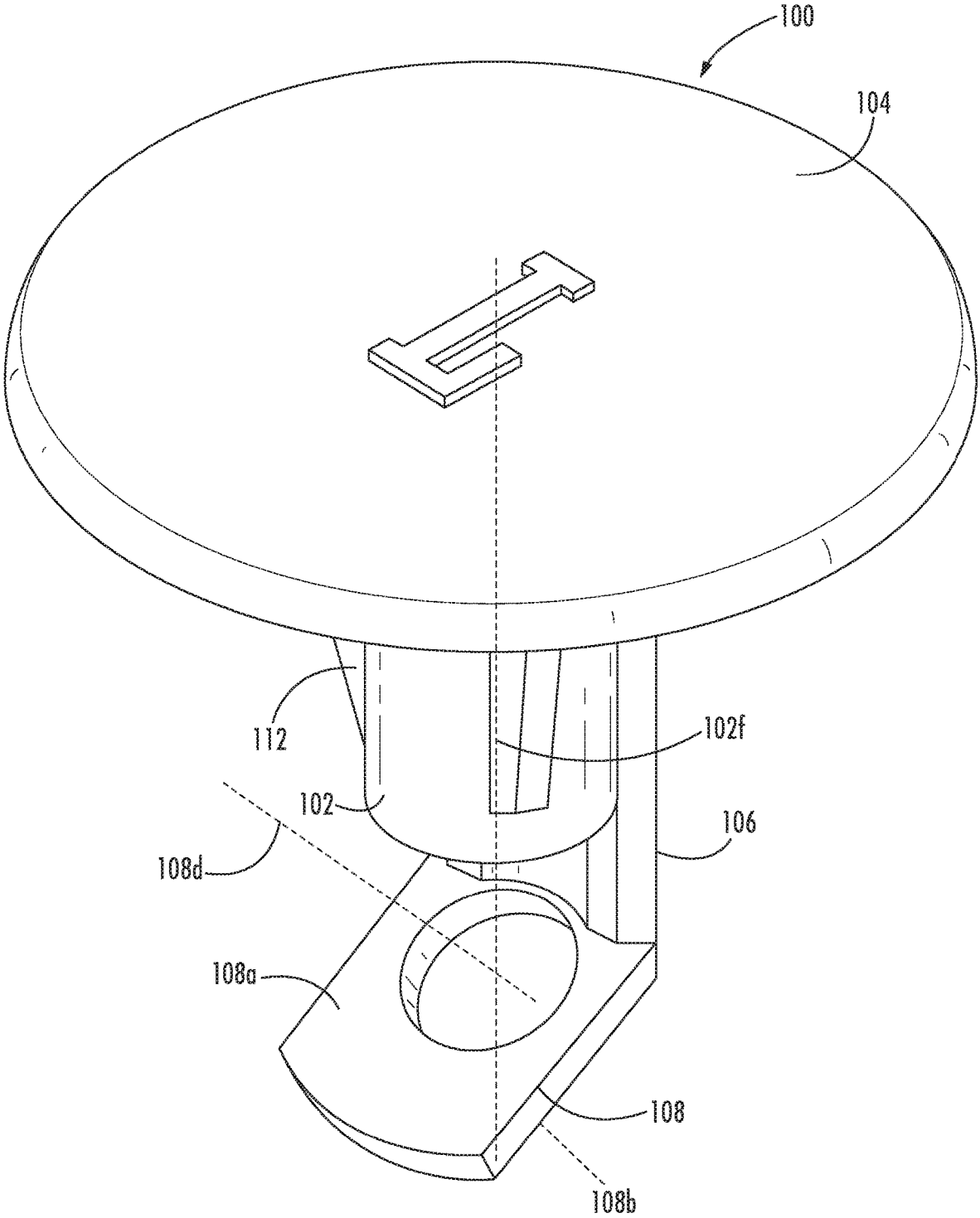
FIG. 1B is a perspective view of the rebar safety cover shown in FIG. 1A.
Figure 1C:
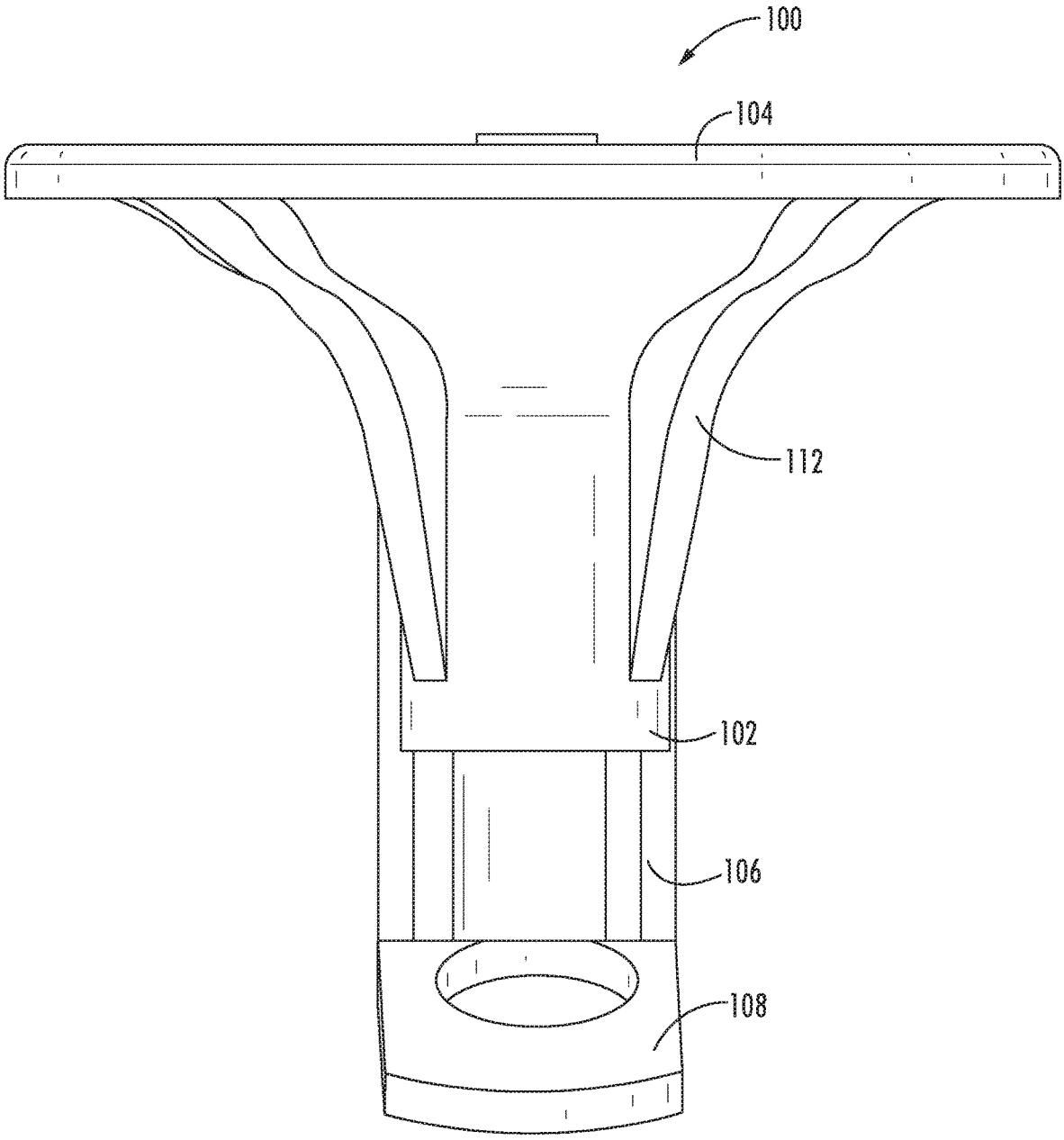
FIG. 1C is a front view of the rebar safety cover shown in FIG. 1A.
Figure 1D:
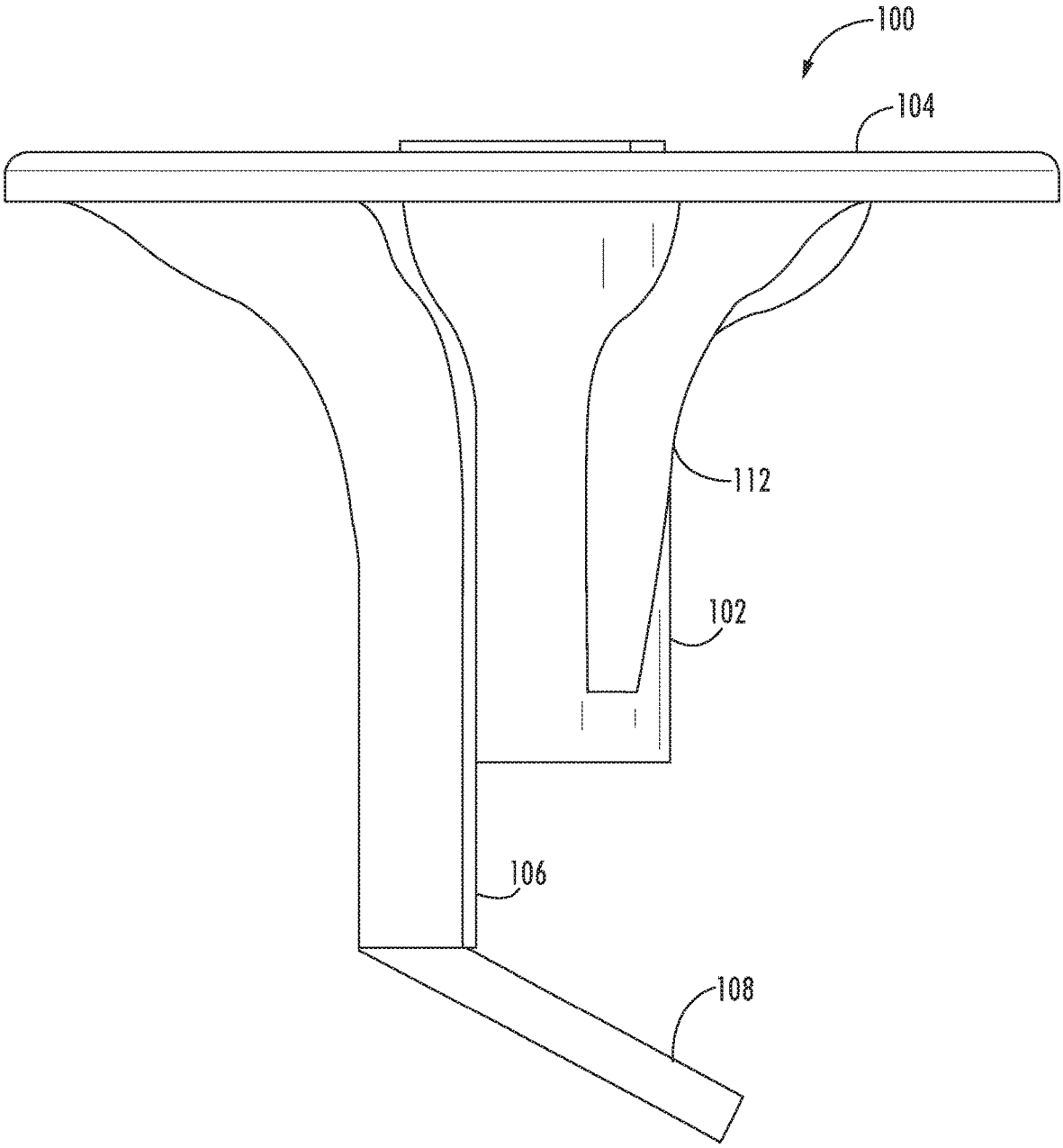
FIG. 1D is a side view of the rebar safety cover shown in FIG. 1A.
Figure 1E:
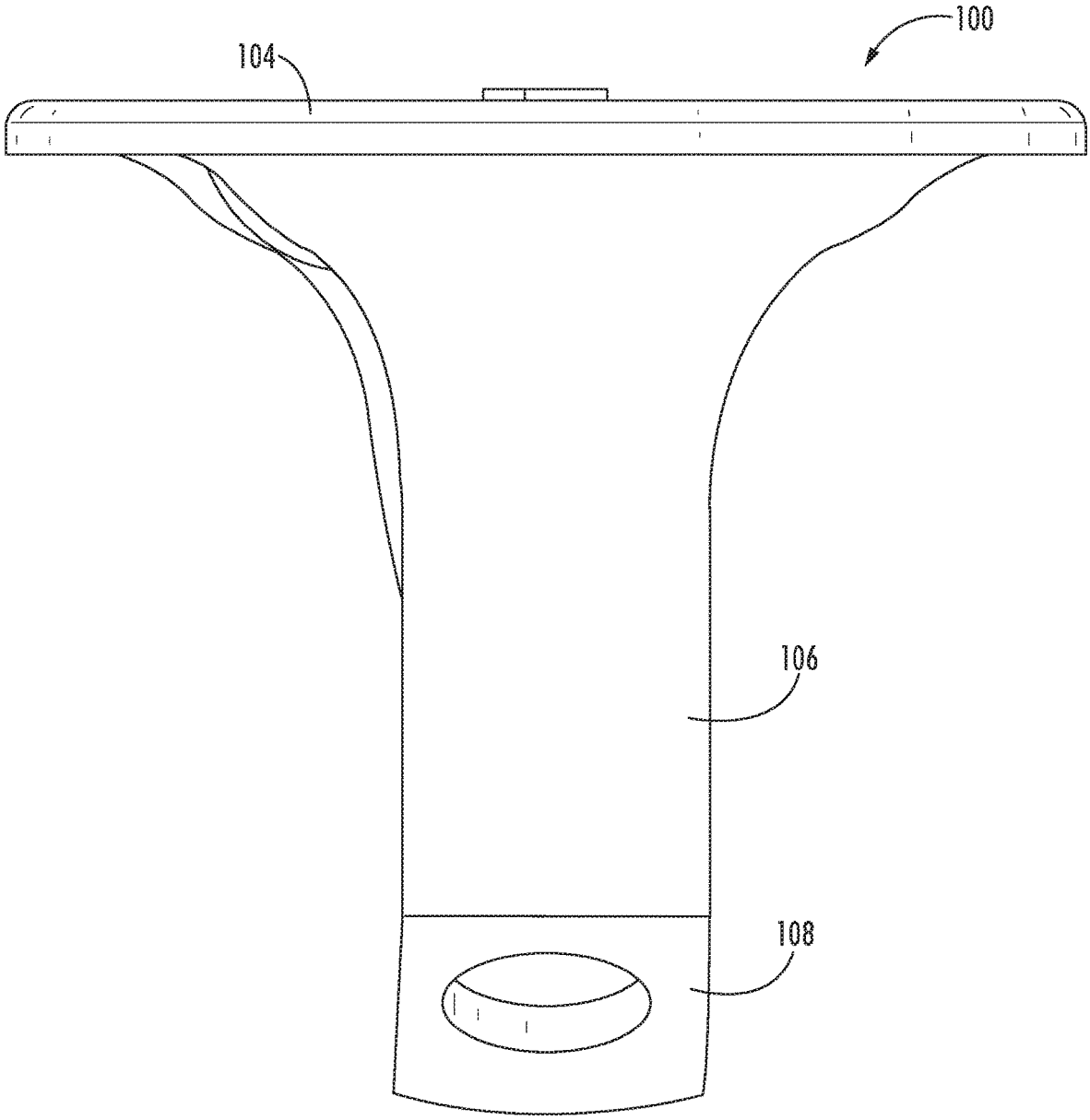
FIG. 1E is a rear view of the rebar safety cover shown in FIG. 1A.
Figure 1F:
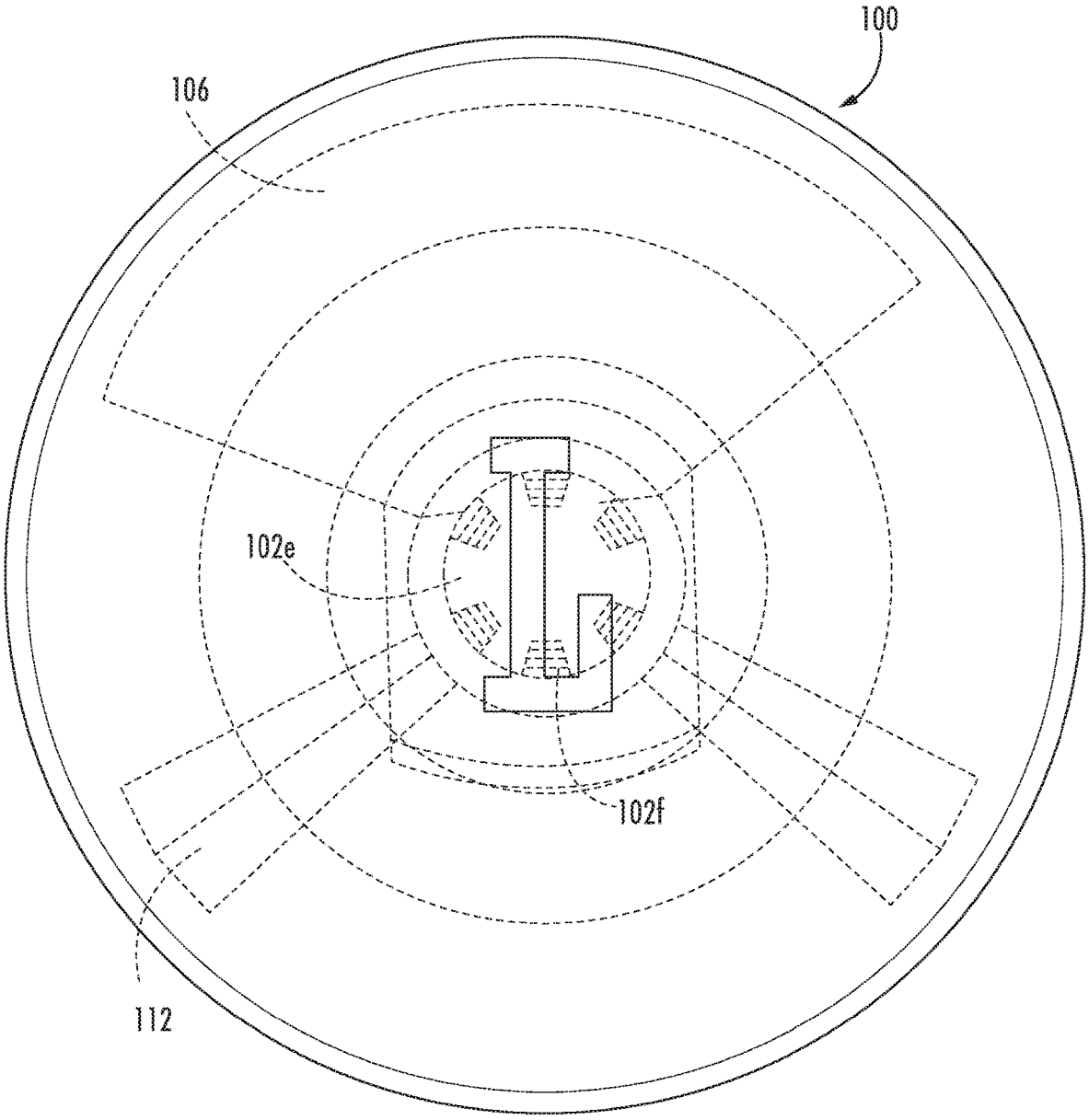
FIG. 1F is a top view of the rebar safety cover shown in FIG. 1A.
Figure 1G:
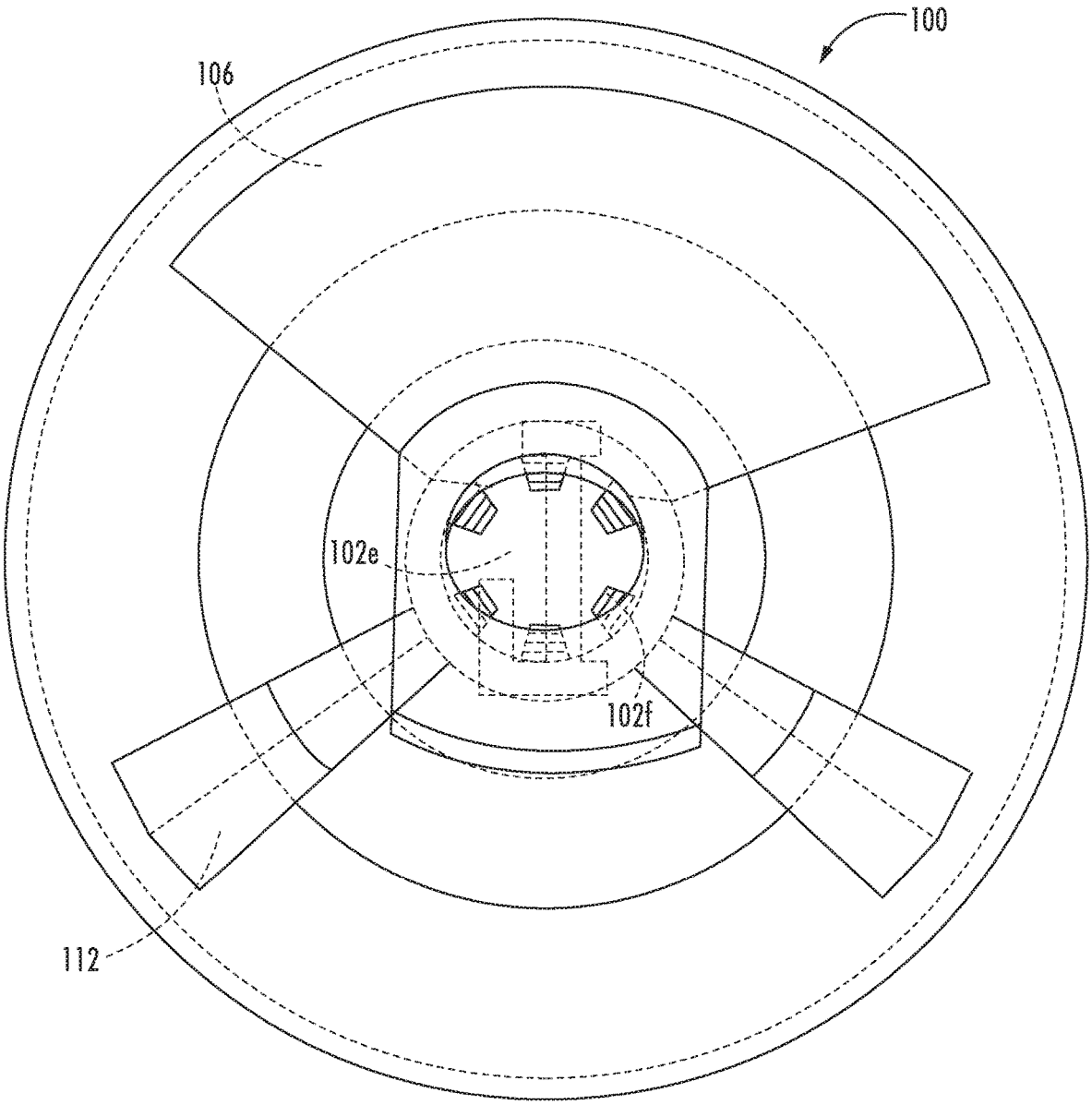
FIG. 1G is a bottom view of the rebar safety cover shown in FIG. 1A.
Figure 1H:
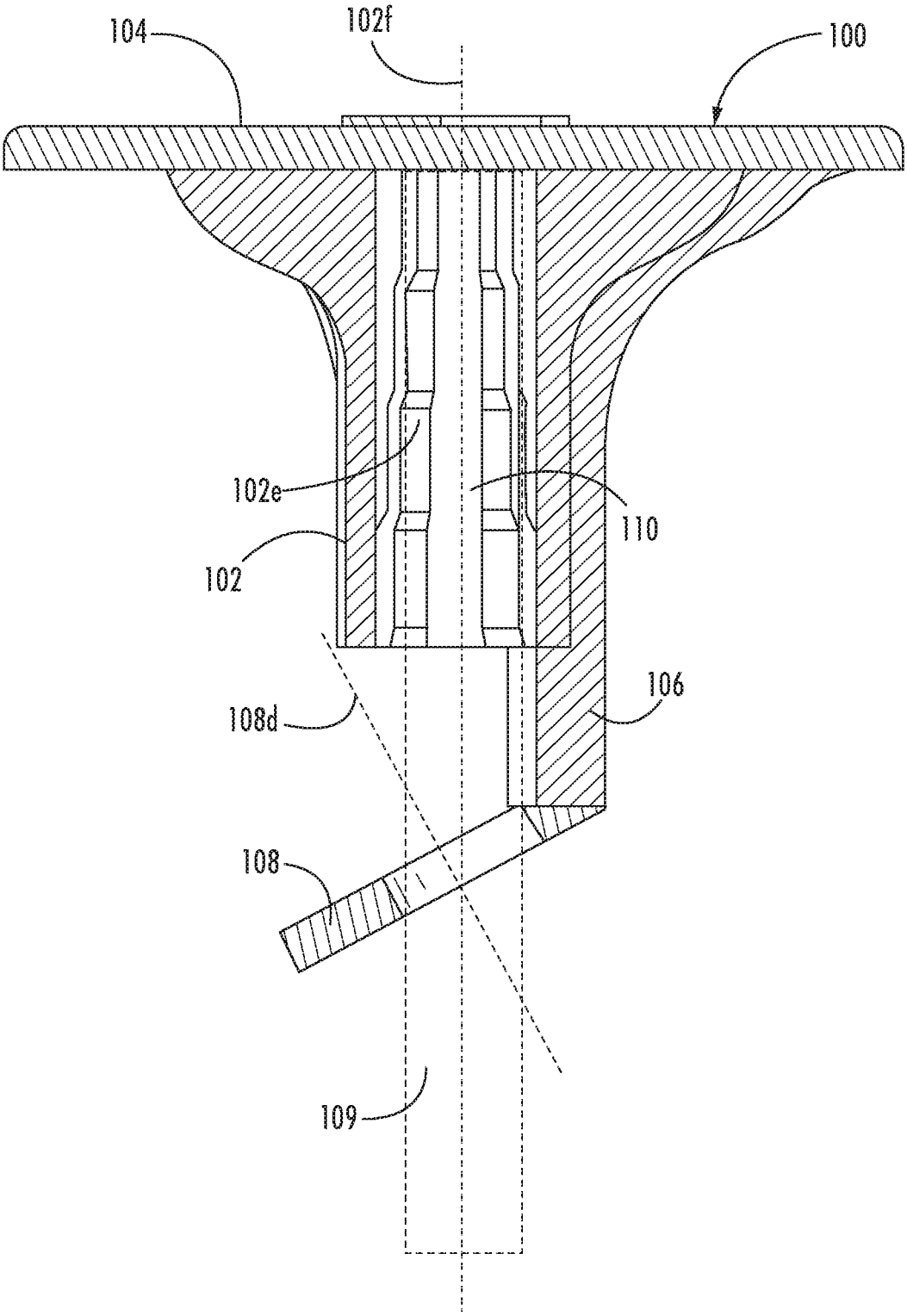
FIG. 1H is a cutaway side view of the rebar safety cover shown in FIG. 1A, with a rebar inserted in the rebar safety cover.

Referring now to FIGS. 1A-1H, a rebar safety cover 100 in accordance with one or more implementations of the disclosure is depicted. In some implementations, the rebar safety cover includes a cylindrical body 102. The cylindrical body 102 has a first end 102*a* and a second end 102*b*. The first end 102*a* and the second end 102*b* each have an outer diameter. The cylindrical body 102 also has an interior wall 102*c* and an exterior wall 102*d*. The cylindrical body 102 defines a hollow channel 102*e* between the first end 102*a* and the second end 102*b*. The hollow channel 102*e* forms an opening between the first end 102*a* and the second end 102*b* such that an object can pass through the hollow channel 102*e*. In some implementations, the hollow channel 102*e* is cylindrically shaped such that the hollow channel 102*e* forms an open tube between the first end 102*a* and the second end 102*b*. The hollow channel 102*e* has a first central axis 102*f* that passes longitudinally through the radial center of the first end 102*a* and the second end 102*b* of the cylindrical body 102. In some implementations, the outer diameter of the first end 102*a* of the cylindrical body 102 is greater than the outer diameter of the second end 102*b* of the cylindrical body 102. In some implementations, the cylindrical body 102 forms a flange shaped structure, where the cylindrical body 102 includes a flange shaped transition surface, such that the outer diameter of the cylindrical body 102 transitions from the outer diameter of the first end 102*a* to the outer diameter of the second end 102*b*.

The rebar safety cover 100 also has a cap 104. In some implementations, the cap 104 is a circular disk-shaped body having a diameter greater than the outer diameter of the cylindrical body 102. In some implementations, the diameter of the cap 104 is 4⅜ inches, although larger or smaller diameters may be used in other implementations. In some implementations, the diameter of the disk-shaped cap 104 is greater than the outer diameter of the first end 102*a* of the cylindrical body 102. Although a circular disk-shaped cap 104 is shown in FIGS. 1A-1H, the cap 104 can have any geometric shape suitable to cover an end of a hollow channel. For example, the cap 104 may have a rectangular, square, or other geometric shape with suitable overall dimensions.

The rebar safety cover 100 also has a locking support 106. The locking support 106 has a first end 106*a* and a second end 106*b*. In the example shown in FIGS. 1A-1H, the length between the first end 106*a* of the locking support 106 and the second end 106*b* of the locking support 106 is greater than the length between the first end 102*a* of the cylindrical body 102 and the second end 102*b* of the cylindrical body 102. In some implementations, the locking support 106 is shaped to couple to the exterior wall 102*c* of the cylindrical body 102. For example, as shown in FIGS. 1A-1H, the locking support 106 has a semi-cylindrical shape, and has a diameter that conforms and couples to the exterior wall 102*d* of the cylindrical body 102 at the first end 102*a*. The second end 106*b* of the locking support 106 has a diameter that conforms to the shape of the exterior wall 102*d* of the cylindrical body 102 at the second end 102*b*, although the second end 106*b* of the locking support 106 extends beyond the second end 102*b* of the cylindrical body 102. In some implementations, the locking support 106 is formed to conform to the shape of the exterior wall 102*d* of the cylindrical body 102.

The rebar safety cover 100 also includes a locking tab 108. In some implementations, the locking tab 108 has a rectangular shape with rounded ends and has a first surface 108*a* and a second surface 108*b* spaced apart and opposite the first surface 108*a*. The locking tab 108 is formed such that it can elastically deform from a natural state or position to a deformed state or position. For example, the locking tab 108 can be formed from a thin piece of metal or polymer that can deform when force is applied to the first surface 108*a*, or the second surface 108*b*. But, the locking tab 108 returns to an undeformed state once the force is removed. The locking tab 108 has an opening 108*c* extending from the first surface 108*a* to the second surface 108*b*. The opening 108*c* has a second central axis 108*d* that passes through the radial center of the opening 108*c* and is perpendicular to the second surface 108*b*. In some implementations, the locking tab 108, also has a connection segment 108*e* such that a portion of the first surface 108*a* of the locking tab 108 is at an angle away from the plane of the second surface 108*b* of the locking tab 108. The opening 108*c* can be circular, square, or any other shape suitable for a rebar 109 to pass through.

In some implementations, the cap 104 is coupled to the first end 102*a* of the cylindrical body 102 such that a radial center of the cap 104 is aligned with the first central axis 102*f* of the cylindrical body 102. The cap 104 is rigidly coupled to the cylindrical body 102. The locking support 106 is rigidly coupled to the exterior wall 102*d* of the cylindrical body 102 and conforms to the shape of the cylindrical body 102. In some implementations, the locking support 106 is coupled to the cylindrical body 102 and the cap 104. In some implementations, the locking support 106 is only coupled to the cap 104 and is disposed on or along the exterior wall 102*d* of the cylindrical body 102 without being coupled to it. The second end 106*b* of the locking support 106 extends beyond the second end 102*b* of the cylindrical body 102. The locking tab 108 is coupled to the locking support 106. In some implementations the connection segment 108*e* is coupled to the second end 106*b* of the locking support 106. The opening 108*c* in the locking tab 108 is positioned in line with the cylindrical body 102, such that the first central axis 102*f* of the hollow channel 102*e* passes through the opening 108*c* of the locking tab 108. The locking tab 108 is disposed in a first position in which a first angle is defined between the first central axis 102*f* and the second central axis 108*d*. The locking tab 108 is movable relative to the cylindrical body 102, such that it can be moved between the first position and a second position. For example, when the locking tab 108 is in the first position, the first axis 102*f* and the second axis 108*d* form a first angle, and when the locking tab 108 is disposed in the second position, the first axis 102*f* and the second axis 108*d* form a second angle, that is less than the first angle. The locking tab 108 can elastically deform between the first position and the second position, where the first position is the natural state of the locking tab. But, the locking tab 108 is formed such that the locking tab 108 is biased to return to the first position, when no force is applied to it as described above.

In some implementations, the rebar safety cover 100 also includes circumferential ribs 110 that are disposed on the interior wall 102*c* of the cylindrical body 102. The circumferential ribs 110 are coupled to the interior wall 102*c* and protrude into the hollow channel 102*e* such that the interior diameter of the hollow channel 102*e* varies according to the radial thickness of each circumferential rib 110. The circumferential ribs 110 can also be formed from the surface of the interior wall 102*c*. For example, the surface of the interior wall 102*c* can be molded into the shape of the circumferential ribs 110, or the circumferential ribs 110 can be etched into the surface of the interior wall 102*c*. The circumferential ribs 110 are arranged in a series along the interior wall 102*c* of the cylindrical body 102. For example, the interior wall 102*c* can be formed in sections of various diameters, decreasing in a direction from the second end 102*b* of the cylindrical body 102, to the first end 102*a* of the cylindrical body 102. In some implementations, each circumferential rib 110 is formed as a uniform body along the interior wall 102*c*. In some implementations, each circumferential rib 110 is separated into segments, dispersed circumferentially around the hollow channel 102*e* and disposed on the interior wall 102*c*. In some implementations, the diameter of the hollow channel 102*e* is ⅜ inch at the first end 102*a* and 1 inch at the second end 102*b*, although larger or smaller diameters may be used at the first end 102*a* and the second end 102*b* in other implementations.

In some implementations, the rebar safety cover 100 also includes a plurality of longitudinal ribs 112. The longitudinal ribs 112 are each formed longitudinally along the length of the cylindrical body 102, and parallel to the first central axis 102*f*. The longitudinal ribs 112 are each formed on the exterior wall 102*d* of the cylindrical body 102. In some implementations, the longitudinal ribs 112 are spaced apart evenly about a circumference of the cylindrical body 102 and conform to the shape of the cylindrical body 102. The longitudinal ribs 112 can form reinforcing structures around the cylindrical body 102 to increase the structural rigidity of the cylindrical body 102. In some implementations, the rebar safety cover 100 is formed from a metal material, such as aluminum, steel, or any other material suitable for forming a rebar safety cover. The rebar safety cover 100 can also have a shell. In some implementations, the shell can be formed from a high-density polymer, such as polypropylene, polyethylene, or a combination of polypropylene and polyethylene. Still other types of suitable polymers may be used in other implementations. In some implementations, the rebar safety cover 100 is formed from a metal core and a high-density polymer shell. In some implementations, the metal core may be present only in the cap 104. In other implementations, the metal core may be present in one or more, or all, of the cylindrical body 102, the cap 104, the locking support 106, and the locking tab 108. In some implementations, the metal core may be omitted, and the entire structure of the rebar safety cover 100 may be formed from a suitable uniform material, such as a high-density polymer, throughout the structure. In some implementations, a combination of suitable materials may be used to form the rebar safety cover 100.

Figure 2A:
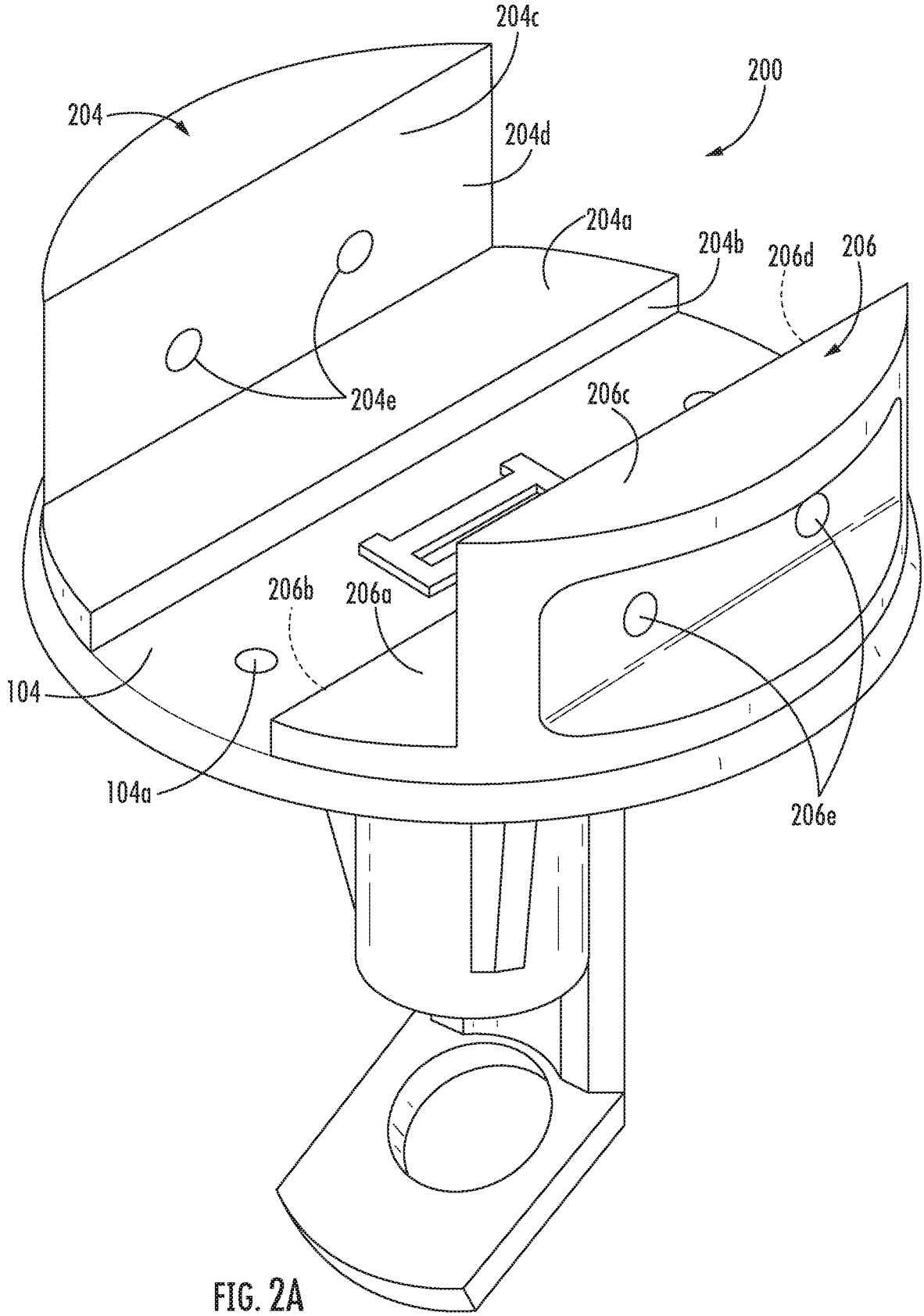
FIG. 2A is a perspective view of an example rebar safety cover in accordance with one or more implementations of the disclosure.
Figure 2B:
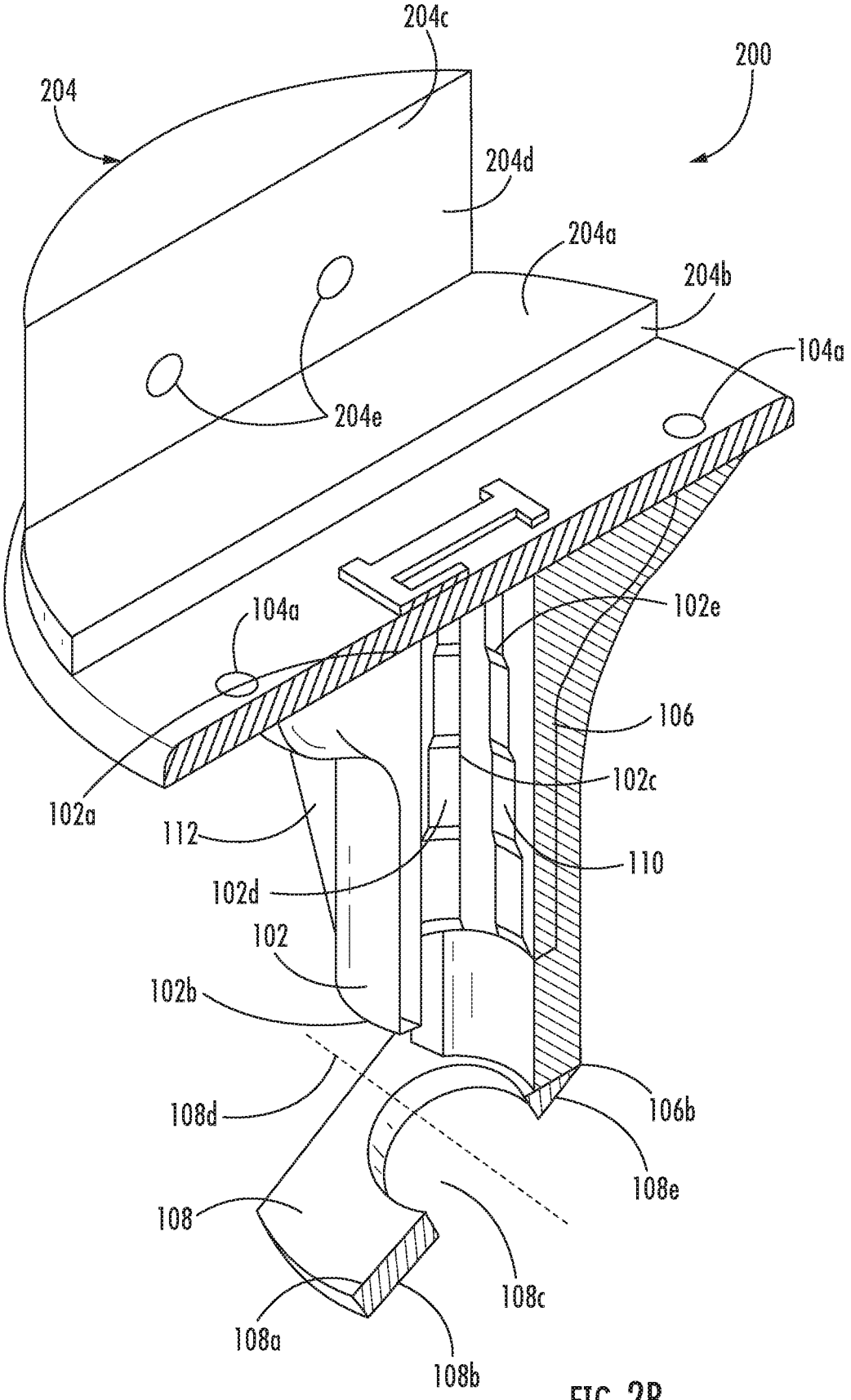
FIG. 2B is a cutaway side view of the rebar safety cover shown in FIG. 2A
Figure 2C:
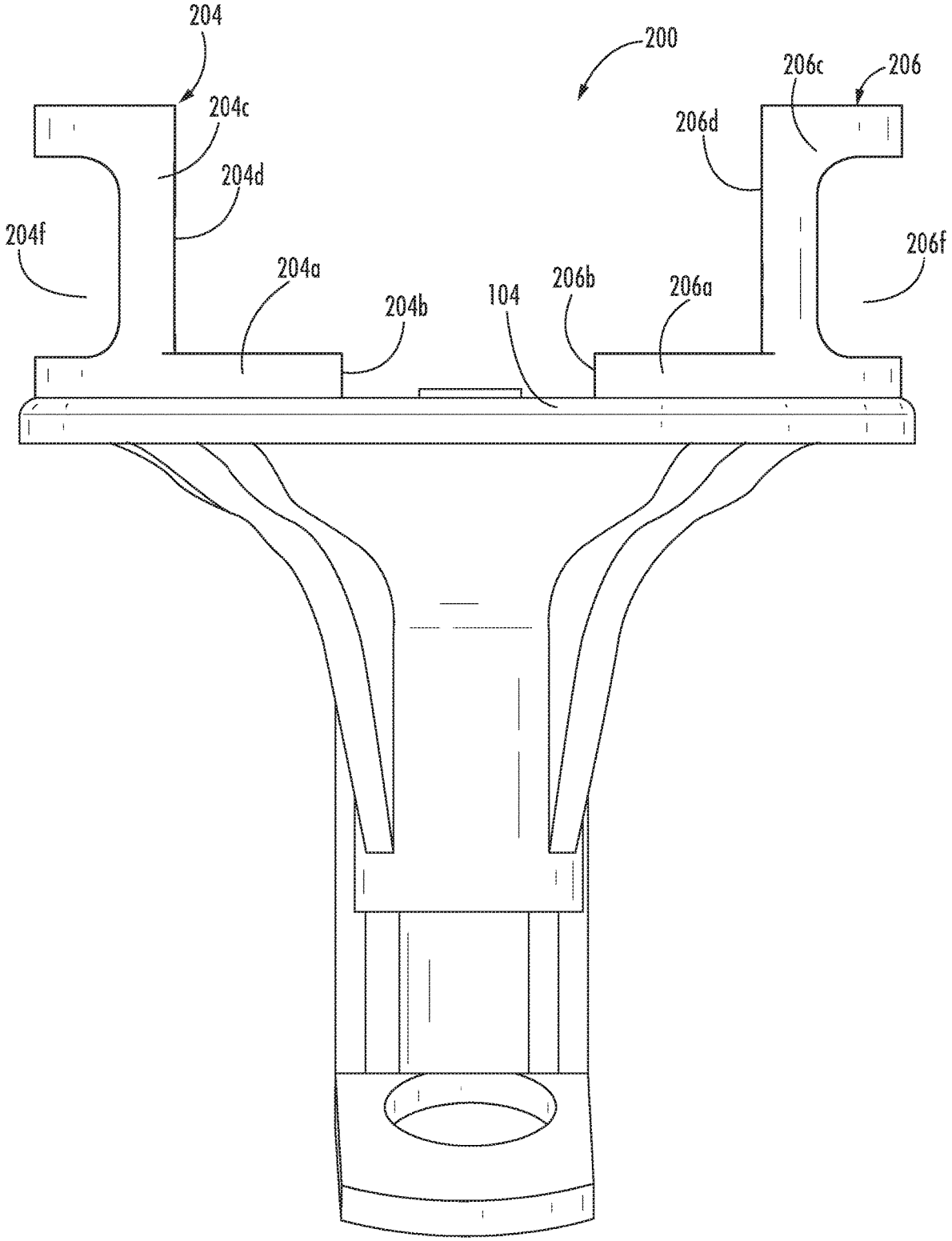
FIG. 2C is a front view of the rebar safety cover shown in FIG. 2A.
Figure 2D:
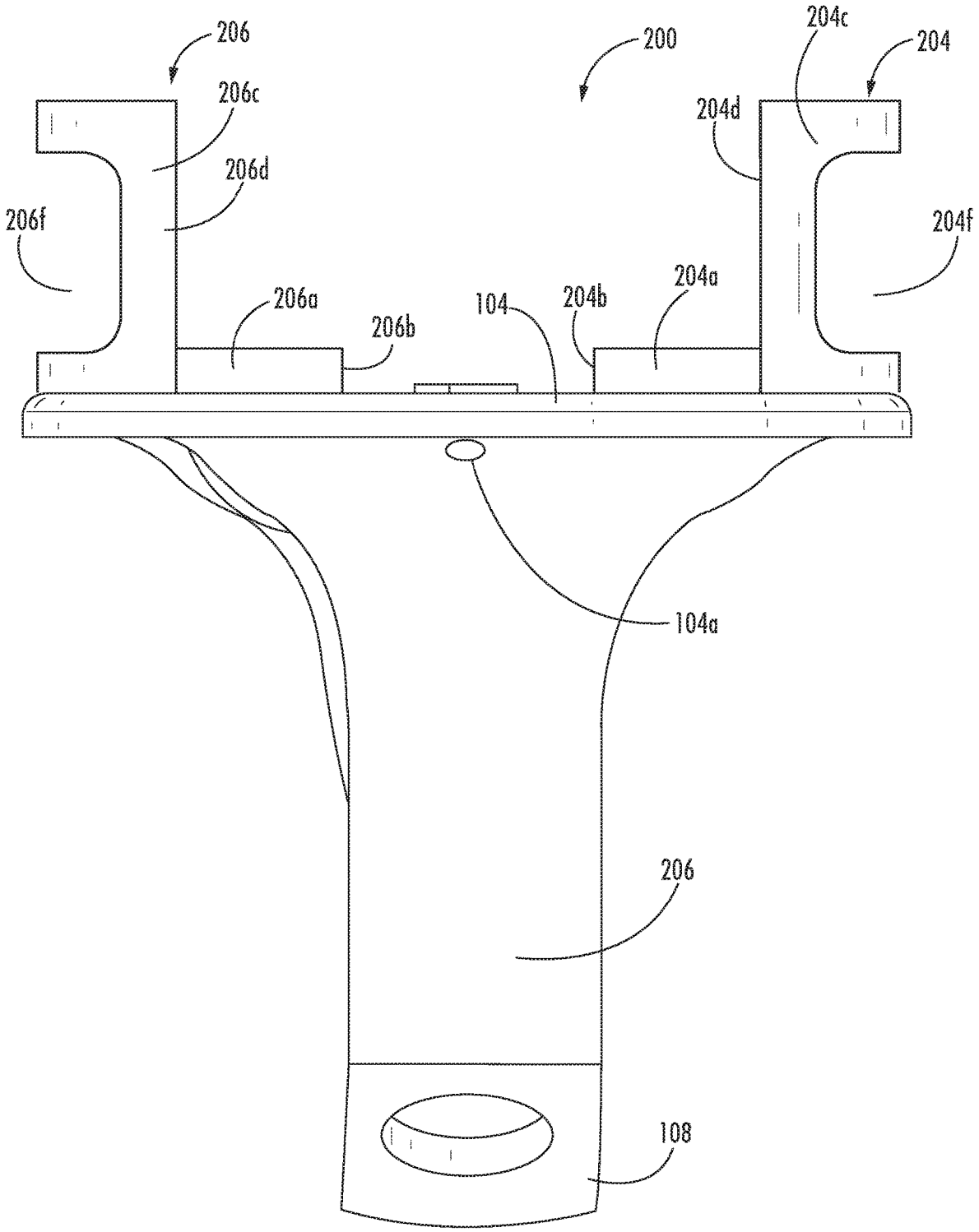
FIG. 2D is a rear view of the rebar safety cover shown in FIG. 2A.
Figure 2E:
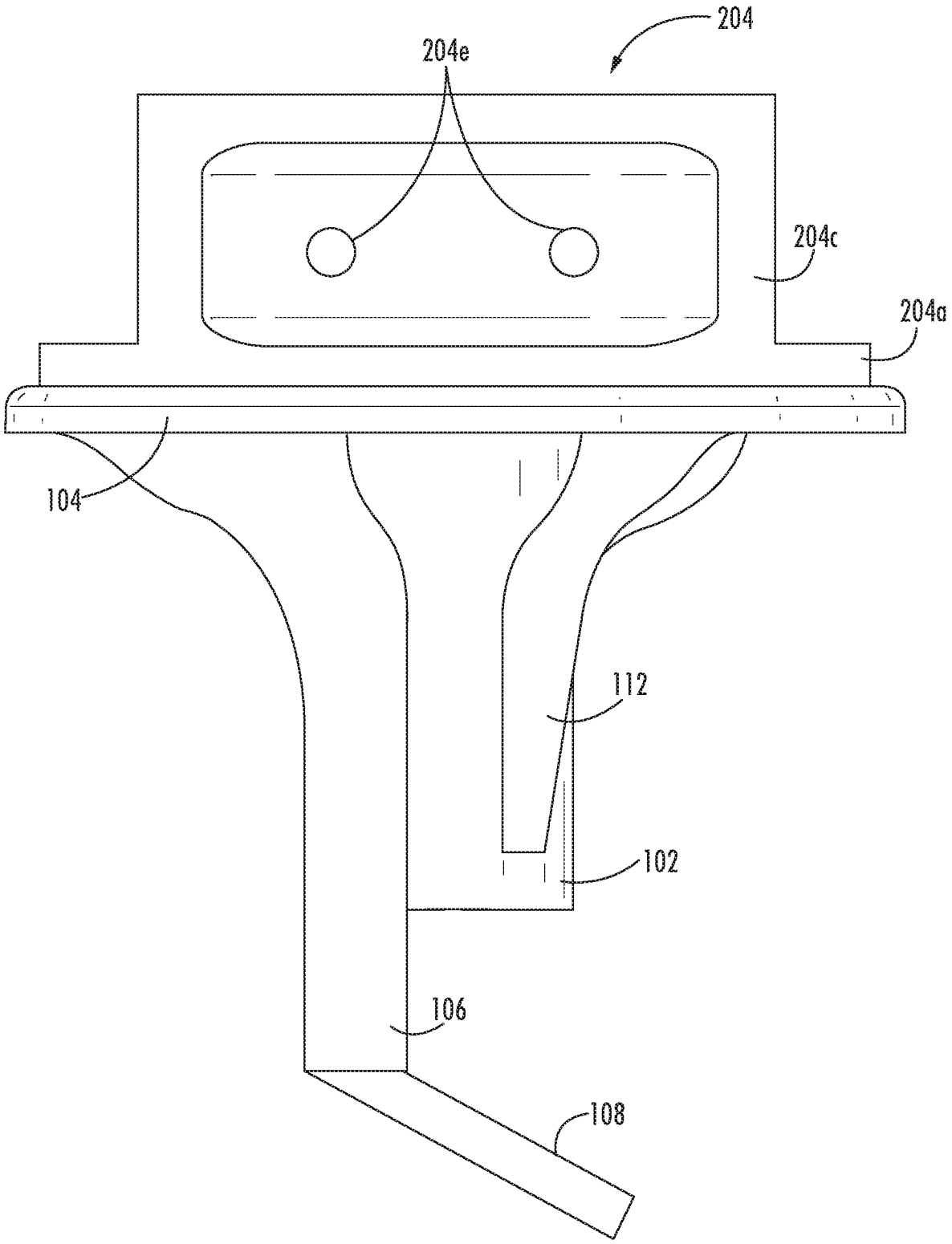
FIG. 2E is a side view of the rebar safety cover shown in FIG. 2A.
Figure 2F:
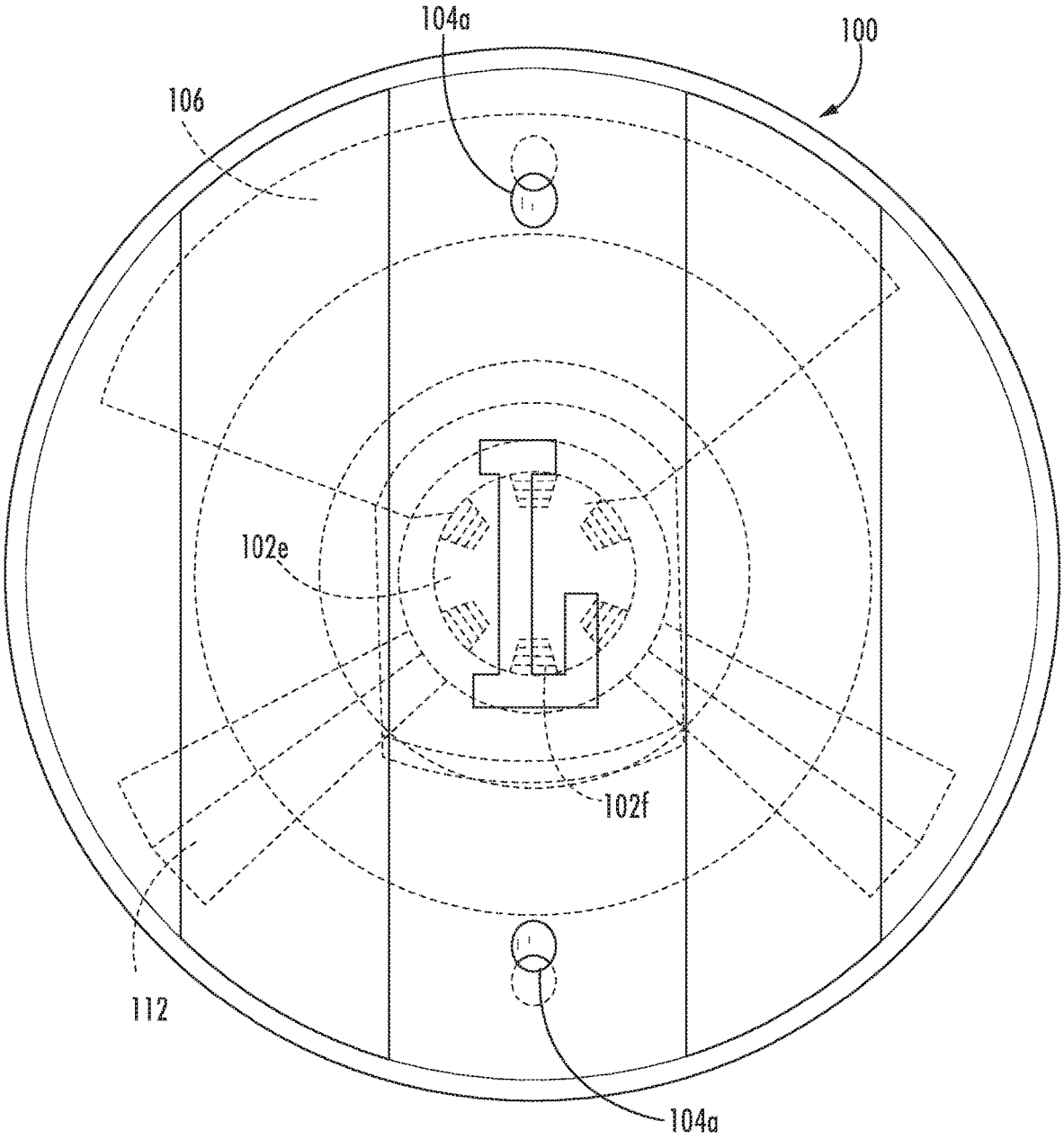
FIG. 2F is a top view of the rebar safety cover shown in FIG. 2A.
Figure 2G:
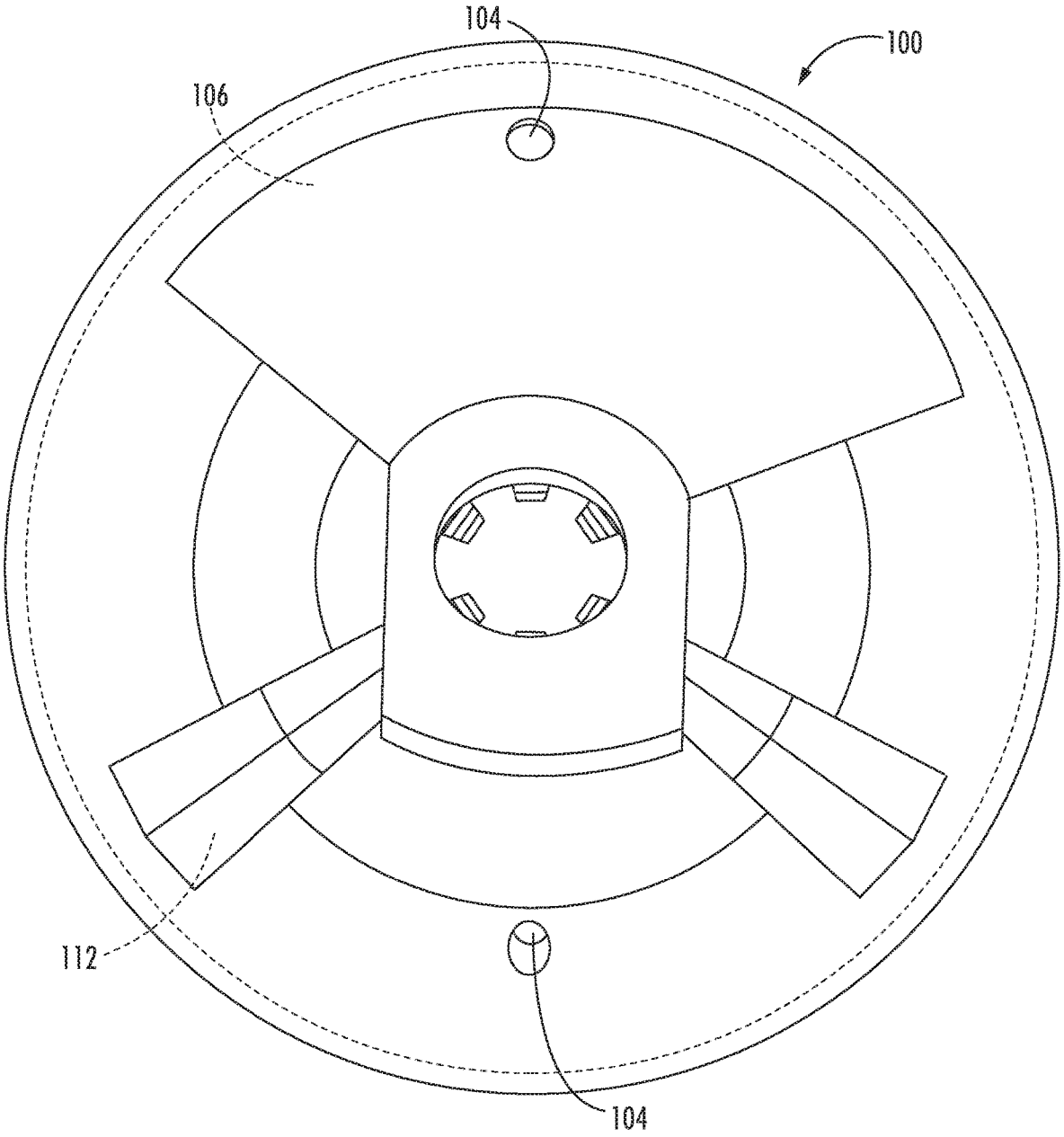
FIG. 2G is a bottom view of the rebar safety cover shown in FIG. 2A.
Figure 2H:
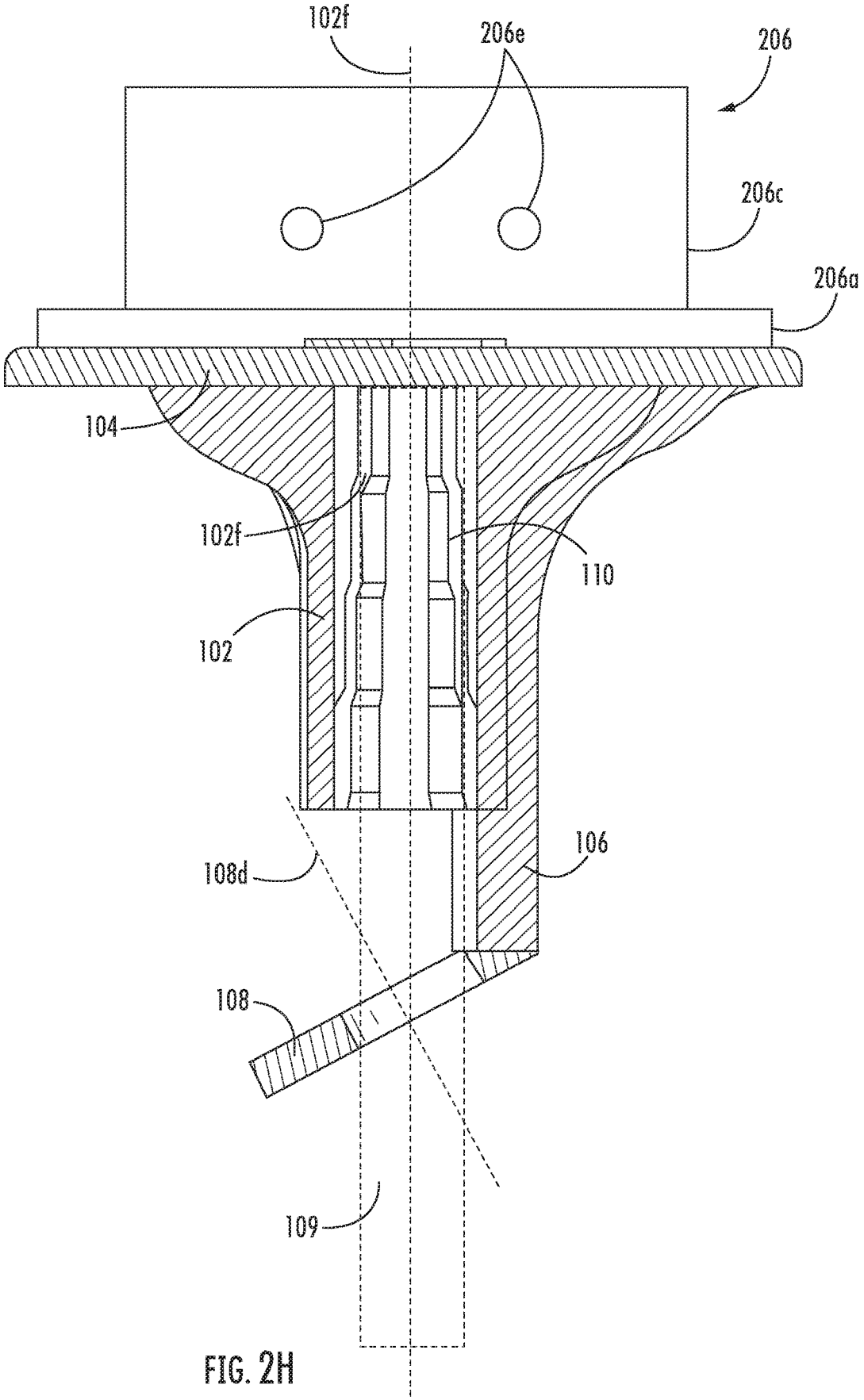
FIG. 2H is a cutaway side view of the rebar safety cover shown in FIG. 2A, with a rebar inserted in the rebar safety cover.

Referring now to FIGS. 2A-2H, a rebar safety cover 200 in accordance with one or more implementations of the disclosure is depicted. In some implementations, the rebar safety cover 200 contains the features of the rebar safety cover 100 described above in FIGS. 1A-1H. The rebar safety cover 200 also includes a first barrier 204 and a second barrier 206. The first barrier 204 and the second barrier 206 each have a platform portion 204*a*, 206*a* having a height and an inner surface 204*b*, 206*b*. Each barrier 204, 206 also has a wall portion 204*c*, 206*c* each also having a height and an inner surface 204*d*, 206*d*. In some implementations, the platform portions 204*a*, 206*a* and the wall portions 204*c*, 206*c* are each semi cylinders. The wall portions 204*c*, 206*c* are semi cylinders that form a smaller fraction of a cylinder than the platform portions 204*a*, 206*a*. The radius of the semi cylinders are the same as a radius of the cap 104, such that the outer diameter of the platform portions 204*a*, 206*a*, and the wall portions 204*c*, 206*c* are aligned with a diameter of the cap 104, where the wall portions 204*c*, 206*c* are coupled to the platform portions 204*a*, 206*a*, and the platform portions 204*a*, 206*a* are coupled to the cap 104.

The first barrier 206 and the second barrier 208 are coupled to the cap 104 and extend away from the cylindrical body 102. The inner surfaces 204*b*, 206*b* of the platform portions 204*a*, 206*a* and the inner surfaces 204*d*, 206*d* of the wall portions 204*c*, 206*c* are each respectively opposite and spaced apart from each other. The space between the inner surfaces 204*b*, 206*b* of the platform portions 204*a*, 206*a* of the barriers 204, 206 is smaller than the space between the inner surfaces 204*d*, 206*d* of the wall portions 204*c*, 206*c* of the barriers 204 206.

In some implementations, the wall portions 204*c*, 206*c* of the first barrier 204 and the second barrier 206 each have at least one hole 204*e*, 206*e* disposed in it. Each hole 204*e*, 206*e* is configured such that a fastener, such as a nail or a screw, can pass through it. In some implementations, each wall portion 204*c*, 206*c* also has a cut-out section 204*f*, 206*f* opposite and spaced apart from the inner surface 204*d*, 206*d* and configured to allow a fastening tool such as a drill or a hammer to interface with the at least one hole 204*e*, 206*e* with minimal obstruction. In some implementations, each wall portion 204*c*, 206*c* has two holes 204*e*, 206*e*. In some implementations, the cap 104 has at least one hole 104*a* disposed in it. Each hole 104*a* is configured such that a fastener, such as a nail or a screw, can pass through it.

During use, the rebar safety cover 100 is placed on an end of a rebar 109. The locking tab 108 is first positioned around the rebar 109 such that the rebar 109 is disposed in the opening 108*c* in the locking tab 108. The cylindrical body 102 is placed over the end of the rebar 109 such that the rebar 109 is disposed inside the hollow cylindrical portion. In some implementations, the locking tab 108 helps hold the rebar 109 in place by interfacing with threads of the rebar 109 or using friction generated between the surfaces of the rebar 109 and the locking tab 108. The rebar safety cover 100 is placed over the end of the rebar 109 and advanced until the rebar 109 contacts the cap 104 or the rebar 109 comes into contact with one of the circumferential ribs 110 such that the circumferential rib 110 is of a smaller diameter than a diameter of the rebar 109. In some implementations, a beam, such as a wooden beam is placed between the first barrier 204 and the second barrier 206. The beam is fastened in place with fasteners, such as nails or screws, driven through a hole 204*e*, 206*e* in the barriers 204, 206 or a hole 104*a* in the cap 104.

In some implementations, the rebar safety cover 100 is removed from the end of the rebar 109 by moving the locking tab 108 from the first position to the second position where the second central axis 108*d* is at an angle closer to the first central axis 102*f* of the hollow channel 102*e*. For example, the locking tab 108 can be pulled, by applying pressure to the second surface 108*b* of the locking tab 108. This disengages the locking tab 108 from thread or friction connection with the rebar 109. The cylindrical body 102 is removed from the end of the rebar 109, and the locking tab 108 is removed from the rebar 109. The locking tab 108 is released, returning the locking tab 108 to the first position. In some implementations, fasteners holding the beam in are removed and the beam is removed from between the first barrier 204 and the second barrier 206.

Although implementations have been described in language specific to structural features and/or methodological acts, it is to be understood that the disclosure is not necessarily limited to the specific features or acts described. Rather, the specific features and acts are disclosed as illustrative forms of implementing the described subject matter. Conditional language, such as, among others, "can," "could," "might," or "may," unless specifically stated otherwise, or otherwise understood within the context as used, is generally intended to convey that certain implementations could include, while other implementations do not include, certain features, elements, and/or steps. Thus, such conditional language is not generally intended to imply that features, elements, and/or steps are in any way required for one or more implementations.

What is claimed is:

1. A rebar safety cover comprising:

a cylindrical body having a first end and a second end, the cylindrical body defining a hollow channel between the first end and the second end, the hollow channel having a first central axis;

a cap coupled to the first end of the cylindrical body;

a locking support coupled to at least one of the cylindrical body and the cap, the locking support having a first end and a second end, the second end of the locking support extending beyond the second end of the cylindrical body; and a locking tab coupled to the locking support, the locking tab having a first surface, a second surface, and an opening extending from the first surface to the second surface, the opening having a second central axis;

wherein the locking tab is configured to move relative to the cylindrical body from a first position defining a first angle to a second position defining a second angle, each said angle located between the first central axis and the second central axis, wherein the second angle is less than the first angle, and wherein the locking tab is resiliently biased to the first position, and in the first position, the first central axis passes through the opening.

2. The rebar safety cover of claim 1, wherein the locking tab is configured for elastically deforming from the first position to the second position, and wherein the first position corresponds to a natural state of the locking tab.

3. The rebar safety cover of claim 1, wherein an outer diameter of the first end of the cylindrical body is greater than an outer diameter of the second end of the cylindrical body.

4. The rebar safety cover of claim 1, further comprising a plurality of longitudinal ribs disposed along an exterior wall of the cylindrical body.

5. The rebar safety cover of claim 1, wherein the cylindrical body, the cap, the locking support, and the locking tab each are formed from a metal core and a high-density polymer shell.

6. The rebar safety cover of claim 1, wherein the cap comprises a circular body.

7. The rebar safety cover of claim 1, wherein the opening in the locking tab has a circular shape.

8. The rebar safety cover of claim 1, wherein the first surface of the locking tab comprises a connection segment, and wherein a plane of the connection segment is angled away from a plane of the second surface of the locking tab.

9. The rebar safety cover of claim 8, wherein the locking tab is coupled to the second end of the locking support via the connection segment.

10. The rebar safety cover of claim 1, further comprising a plurality of circumferential ribs disposed on an interior wall of the cylindrical body, wherein each of the circumferential ribs defines an interior diameter of the hollow channel.

11. The rebar safety cover of claim 10, wherein the circumferential ribs are arranged in series along the interior wall of the cylindrical body in a direction of the first central axis.

12. The rebar safety cover of claim 11, wherein the interior diameter of the hollow channel decreases in a direction from the second end toward the first end of the cylindrical body.

13. A rebar safety cover comprising:

a cylindrical body having a first end and a second end, the cylindrical body defining a hollow channel between the first end and the second end, the hollow channel having a first central axis;

a cap coupled to the first end of the cylindrical body;

a first barrier and a second barrier coupled to the cap and extending away from the cylindrical body, wherein the first barrier and the second barrier each comprise:

a platform portion having an inner surface; and a wall portion having an inner surface, wherein a height of the inner surface of the wall portion is greater than a height of the inner surface of the platform portion, wherein the inner surface of the wall portion of the first barrier is opposite and spaced apart from the inner surface of the wall portion of the second barrier;

a locking support coupled to at least one of the cylindrical body and the cap, the locking support having a first end and a second end, the second end of the locking support extending beyond the second end of the cylindrical body; and a locking tab coupled to the locking support, the locking tab having a first surface, a second surface, and an opening extending from the first surface to the second surface, the opening having a second central axis;

wherein the locking tab is configured for moving relative to the cylindrical body from a first position in which a first angle is defined between the first central axis and the second central axis to a second position in which a second angle is defined between the first central axis and the second central axis, and wherein the second angle is less than the first angle.

14. The rebar safety cover of claim 13, wherein each of the wall portions further comprises at least one hole disposed therein.

15. The rebar safety cover of claim 13, wherein the cap further comprises at least one hole disposed therein.

16. The rebar safety cover of claim 13, wherein the platform portions and the wall portions are each formed as semi cylinders, and wherein the wall portions form smaller semi cylinders than the platform portions.

17. A method of covering and uncovering an end of a rebar, the method comprising:

positioning a safety cover relative to the end of the rebar such that the rebar extends through an opening in a locking tab of the safety cover and a portion of the rebar is received within a hollow channel defined by a cylindrical body of the safety cover, and such that the locking tab is resiliently biased to a first position in which the locking tab engages a portion of the rebar and a first angle is defined between a first central axis of the hollow channel and a second central axis of the opening, wherein an acute angle is defined between the second central axis and a longitudinal axis of the rebar in the first position of the locking tab;

moving the locking tab relative to the cylindrical body from the first position to a second position in which the locking tab is disengaged from the portion of the rebar and a second angle is defined between the first central axis and the second central axis, wherein the second angle is less than the first angle; and removing the safety cover from the rebar.

18. The method of claim 17, further comprising placing a beam between a first barrier and a second barrier of the safety cover, wherein the first barrier and the second barrier are coupled to a cap of the safety cover and extend away from the cylindrical body.

19. The method of claim 18, further comprising securing the beam to the safety cover with at least one fastener extending through at least one hole formed in the first barrier or the second barrier.

20. The method of claim 18, further comprising securing the beam to the safety cover with at least one fastener extending through at least one hole formed in the cap.

* * * * *